United States Patent [19]

Luckey

[11] 4,098,372

[45] Jul. 4, 1978

[54] COLLAPSIBLE LADDER

[76] Inventor: Wilhelm Luckey, Heidenbergstrasse 31, 3538 Marsberg, Fed. Rep. of Germany

[21] Appl. No.: 774,133

[22] Filed: Mar. 3, 1977

[51] Int. Cl.[2] ..... E06C 1/56

[52] U.S. Cl. ..... 182/196

[58] Field of Search ..... 182/196, 197, 198, 228, 182/73, 74

[56] References Cited

U.S. PATENT DOCUMENTS 1,680,032 8/1928 Anderson ..... 182/228

2,887,261 5/1959 McGuire ..... 182/198

FOREIGN PATENT DOCUMENTS 614,887 2/1961 Canada ..... 182/196

*Primary Examiner*—Reinaldo P. Machado

[57] ABSTRACT

A collapsible ladder made of non-combustible material, which can be used for example as a fire escape, comprises two flexible strings with rungs threaded thereon at spaced distances, and these rungs have divergent limbs dimensioned so that, when the ladder is collapsed, the rungs seat on one another leaving a space between them for stowage of the parts of the strings.

6 Claims, 4 Drawing Figures

FIG. 2
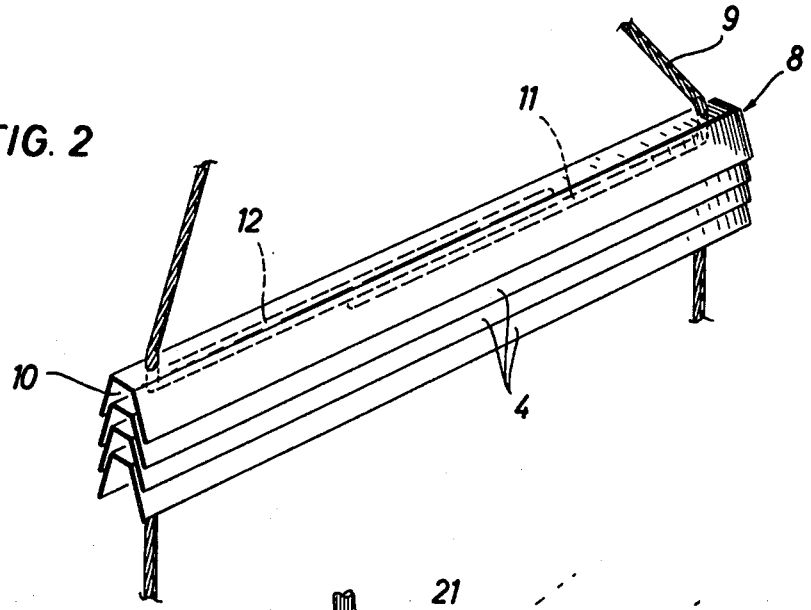
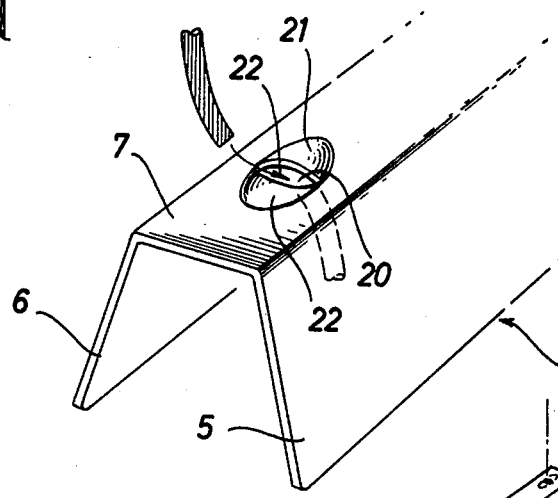
FIG. 3
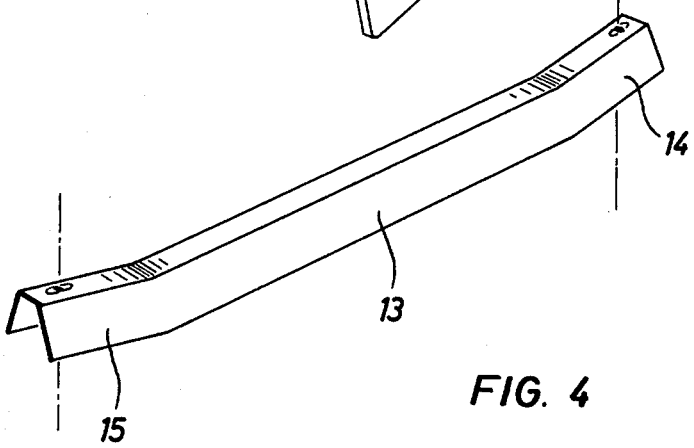
FIG. 4

COLLAPSIBLE LADDER

This invention relates to a collapsible ladder of non-combustible material comprising a plurality of rungs in the form of treads spaced at intervals along elements of a cable or strip nature, these rungs being of the same U-shape cross section and being stackable on one another in such a way as to leave between each pair of adjacent rungs a free hollow area for complete reception of the sections of the cable or strip elements between the rungs.

A collapsible ladder of this character which is known from U.S. Pat. specification No. 3,415,341 is of relatively complicated construction. The manufacture of such ladders involves considerable difficulties. Apart from this the individual rungs are held at both sides by a doubled cable and the shape of the rungs is relatively complicated.

It is an object of this invention to provide a ladder of the type set forth above which not only occupies a minimum amount of space, but can also be used for example as a fire escape.

To this end the invention comprises an arrangement in which each rung comprises two limbs divergent relatively from a tread and that in the collapsed condition of the ladde these seat astraddle the limbs of the rung next therebelow, and the said elements are each received and held in corresponding openings at the corresponding end of a rung.

A collapsible ladder constructed in this way needs only a minimum of space when so collapsed. Depending on the spacing between the rungs it is possible to provide a ladder which, despite the fact that it can extend over a number of stories of a building, can be readily installed in a box or case on the ground.

In accordance with a preferred embodiment of the invention the end parts of the rungs are turned or inclined upwards. The sections of the cable or strips accommodated in the hollow area can extend in crossed fashion over the complete length of the rungs.

The rungs moreover may be of a plate material of less than 1 mm thickness; they might for example be made of aluminum.

Advantageously each said opening is defined by two opposed crescent-shaped edges which are pressed out of the tread surface in opposite directions.

Embodiments of the invention are illustrated by way of example in the accompanying drawings in which:

FIG. 2 shows the ladder of FIG. 1 in collapsed condition,

FIG. 3 illustrates a detail of this embodiment, and

FIG. 4 shows a modified version of the rail used in the ladder of this invention.

Figure 1:
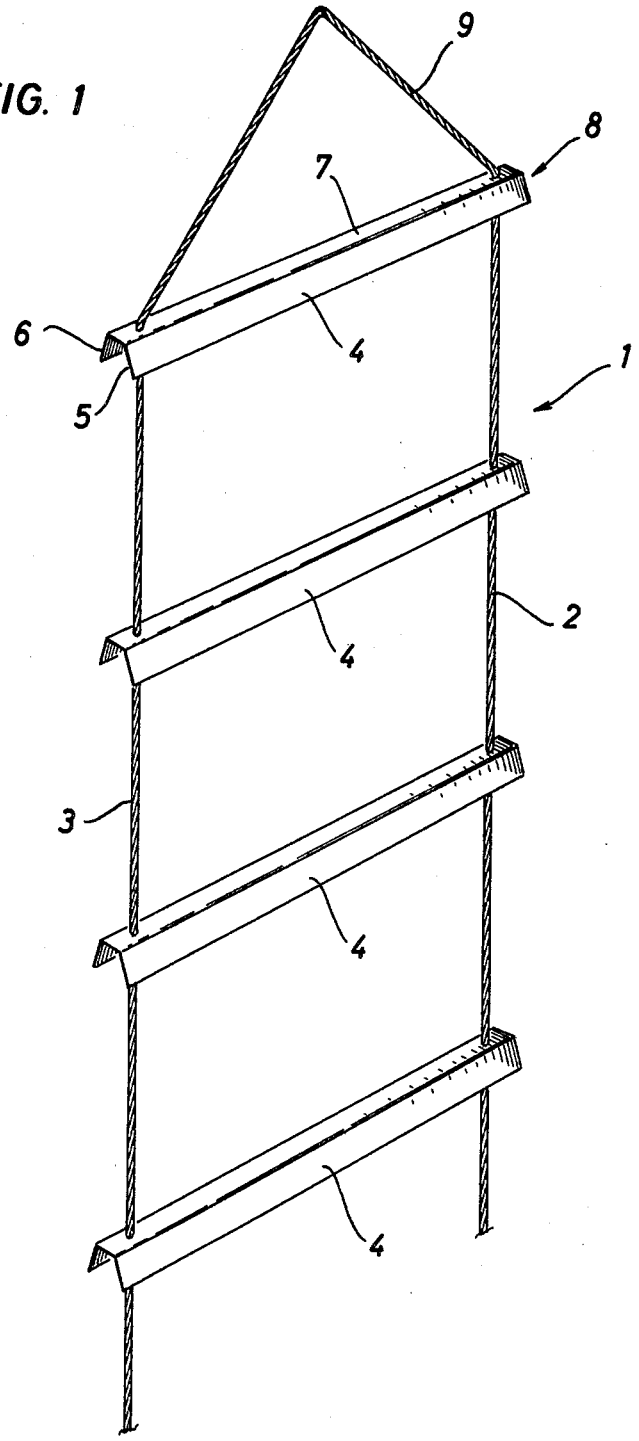
FIG. 1 shows a ladder in accordance with the invention in condition ready for use.

The collapsible ladder 1 illustrated in the drawings comprises two parallel metal wires or cables 2, 3, for example with a diameter of 1.5 mm, carrying regularly spaced rungs 4. These rungs consist of a metal plate bent into U-shape or a corresponding metal strip; these rungs may for example have a thickness of about 0.8 mm, and they can be of aluminum, steel sheet, or other metal.

The rungs 4 in the drawings are of U-form, and the limbs 5, 6 are divergent relatively to the tread 7 which is formed by the web between the limbs. These rungs may for example be galvanized or made rustproof in other ways.

Provided above the upper rung 8 is a loop 9 of wire used to suspend the collapsed ladder in any convenient way. Where the ladder is to be used as a fire escape, this can for example be hung on a window cross. It will be understood that hanging or suspension is possible on any other projecting edge or the like.

As stated above the rungs are of U-shape in cross section and the transition between the limbs 5 and 6 and the tread 7 is polygonal; instead of this polygonal construction however use may be made of a U-shaped rounded cross section with divergent limbs. Further the rungs may be made simply and inexpensively by cutting tools or by simple folding; they are compact and safe to use.

FIG. 2 illustrates the ladder in collapsed condition. The individual rungs 4 are so pushed together as to provide a hollow space 10 between each pair of adjacent rungs sufficient to accommodate sections 2 and 3 of the wire between one tread and the next. Whilst in the embodiment of FIG. 2 the sections 11 and 12 of the wire are simply laid together, in a preferred embodiment (not actually illustrated=), the distance between two rungs can be chosen equal to the length of the rungs themselves. In this event the rungs are so stacked that the ends of an upper rung is turned through 180° in reference to the lower rung and the two metal wire sections 2 and 3 can be accommodated in cross fashion in the hollow space 10.

If necessary other and greater distances can be provided between the individual rungs, for example twice the length of a rung.

In the case of the rung illustrated in FIG. 4 the end sections 14 and 15 are slightly bent or inclinded upwards relatively to the middle section 13. Apart from this the ladder is of the same construction as that described in reference to FIGS. 1 and 2.

Whilst the metal wires 2 and 3 can be fastened to the rungs 4 and 8 in any suitable fashion, it has been found particularly advantageous in simplified manufacture to provide slots 20 of a form such that one edge of the slot is turned upwards in the form of a crescent 21 and the other edge 22 is turned downwards, likewise in crescent form. The metal wire is then clamped in the slot 20 as indicated by the arrow 22.

Where for example the thickness of the rungs, as indicated above, is 0.8 mm, the length thereof is about 25 – 27 cm and the distance between the rungs is a corresponding amount, an approximately 1 m long collapsible ladder section with up to five rungs will require a space of 4 – 4.5 cm heightwise. In consequence a fire escape of for example 5 m length would only be of about 25 cm width in the collapsed condition. These dimensions, chosen by way of example, will clearly show that installation of the ladder of this invention in collapsed or stacked condition is extraordinarily compact.

In appropriate conditions of course the rungs may be shorter and the wire sections longer so that the collapsed rungs in the stacked condition will require even less space despite an even longer ladder.

It will be obvious that instead of using a metal wire, a metal strip or other non-combustible metal could be used for the rungs and for the cable or strip-like elements, for example plastics.

Another form of the possibility of using the ladder as a fire escape or an emergency ladder consists in engaging and clamping the ladder, for example between the first and second rungs in an upper cross piece of a casement and the window frame. This will counteract any shifting or sliding of the foot.

What is claim is:

1. In a collapsible ladder of non-combustible material having two flexible lines and a plurality of rungs spaced along and between said lines, the rung improvement comprising a tread section having divergent limbs extending therefrom to form a U-shaped cross section for nesting astride adjacent rungs relative to one another in spaced fashion, and to provide intermediate spaces for receiving and uncovering said two flexible lines in stowage position, and said lines pass through and are respectively held in openings proximate the ends of each rung.

2. The apparatus of claim 1 wherein said rungs further comprise an upward bend at each end part.

3. The apparatus of claim 1 wherein said flexible lines are crossed between respective rungs in said intermediate spaces in stowage position.

4. The apparatus of claim 1, wherein said rungs are made of a plate material of less that 1 mm thickness.

5. The apparatus of claim 1 wherein the rungs are made from aluminum.

6. The apparatus of claim 1, wherein the rung openings each further comprise two opposed crescent-shaped edges which are pressed out of said rung tread section in opposite directions.

* * * * *